US011147394B2

(12) United States Patent
Vogler et al.

(10) Patent No.: US 11,147,394 B2
(45) Date of Patent: Oct. 19, 2021

(54) SECURE DISPLAY CABINET

(71) Applicant: MARKETING IMPACT LIMITED, Concord (CA)

(72) Inventors: Michael Vogler, Concord (CA); Martin Gil, Concord (CA); Marian Kosara, Concord (CA)

(73) Assignee: Marketing Impact Limited, Concord (CA)

( * ) Notice: Subject to any disclaimer, the term of this patent is extended or adjusted under 35 U.S.C. 154(b) by 0 days.

(21) Appl. No.: 16/664,384

(22) Filed: Oct. 25, 2019

(65) Prior Publication Data

US 2021/0120975 A1 Apr. 29, 2021

(51) Int. Cl.
*A47F 3/00* (2006.01)
*A47F 5/00* (2006.01)

(52) U.S. Cl.
CPC ..... *A47F 3/002* (2013.01); *A47F 5/0018* (2013.01)

(58) Field of Classification Search
CPC .. A47F 3/00; A47F 3/002; A47F 3/005; A47F 3/12; A47F 3/125; A47F 2003/008; A47F 5/0018; A47F 5/0861; A47F 7/024; A47B 47/02; A47B 95/00; A47B 95/04
USPC ..... 312/138.1, 139, 139.1, 139.2, 309–311
See application file for complete search history.

(56) References Cited

U.S. PATENT DOCUMENTS 871,877 A * 11/1907 Lyons ..... A47F 3/00 312/139.1
1,516,404 A * 11/1924 Palmenberg ..... A47F 3/005 312/139.1
3,334,953 A * 8/1967 Becker ..... G07F 9/10 312/351.1
4,070,074 A * 1/1978 Rohme ..... E05D 3/022 109/70
4,591,214 A * 5/1986 Reuter ..... E05D 15/582 312/110
4,865,248 A * 9/1989 Barth ..... A47G 29/20 232/24
5,050,944 A * 9/1991 Fricano ..... A47B 67/00 312/323
5,399,010 A * 3/1995 McClung ..... E06B 3/5045 312/322
5,584,517 A * 12/1996 Simnacher ..... E05B 17/2088 292/340
7,661,545 B2 2/2010 Hardy et al.
(Continued)

*Primary Examiner* — Andrew M Roersma
(74) *Attorney, Agent, or Firm* — Ridout and Maybee LLP

(57) ABSTRACT

A merchandise display cabinet for use with a shelf panel of a merchandise display feature is disclosed. The cabinet includes a housing having a front panel, the housing defining an interior chamber for storing items of merchandise and a lock assembly operably coupled to the front panel for controlling access to the interior chamber. The front panel is configured for sliding relative to the housing via integral sliding features on the housing, the front panel defining a closed position wherein access to the interior chamber is prevented and an open position wherein access is permitted. The lock assembly is configured such that while disposed in the locked condition, the locked condition defines a first interference condition and a second interference condition such that provided at least one of the first and second interference conditions is in effect the front panel is prevented from being disposed in the open condition.

18 Claims, 6 Drawing Sheets

(56) References Cited

U.S. PATENT DOCUMENTS

| | | | | |
|---|---|---|---|---|
| 8,485,391 | B2 * | 7/2013 | Vlastakis | A47F 3/002 221/15 |
| 9,364,101 | B1 * | 6/2016 | Anderson | A47F 3/007 |
| 9,404,290 | B2 * | 8/2016 | Leyden | A47F 7/024 |
| 9,863,167 | B1 * | 1/2018 | Garrett | E05B 65/46 |
| 2004/0060944 | A1 * | 4/2004 | Gervasi | G08B 3/02 221/263 |
| 2012/0285911 | A1 * | 11/2012 | Valiulis | A47F 5/0861 211/59.2 |

* cited by examiner

SECURE DISPLAY CABINET

FIELD

The present disclosure relates to a merchandise display cabinet for securely storing, displaying and/or dispensing one or more retail products or items of merchandise on a display feature.

BACKGROUND

Theft of retail items in retail stores is a major concern for most retailers. In the case of higher cost merchandise items such as, for example, analgesics, cough and/or cold medications, razors, razor blades, camera film, batteries, videos, DVDs, smoking cessation products, infant formula and/or the like, which products are often the targets of shoplifters, preventing theft of these retail items is often a priority for retailers and/or employees of the retailers.

Traditionally, higher cost retail items are often removed from shelves and are often placed behind store counters and/or securely stored under lock and key, only accessible by one or more employees of the retailers. While this security approach is often effective in preventing theft of these retail items, such security approach often presents subsequent problems associated with access and availability of these retail items to customers desiring to purchase the retail items. For example, customers may often be deterred by having to request access to the retail items that are only stored over-the-counter by an employee. Storing higher cost retail items behind the counter also limits opportunities for visual display of the retail items to potential customers. Furthermore, relying on space behind store counters for securely storing the higher cost retail items can be challenging as the available space may be limited and/or non-existent and, as a result, inventories of these retail articles may be at lower amounts than anticipated by customers which may undesirably lead to unavailability of the retail articles in times of need.

In some instances, retailers provide shelving security devices and/or other security measures that sometimes deter theft of these retail items and/or OTC products while still allowing the retail items, or OTC products, to be displayed to potential customers. However, typical shelving security devices often lack durability and can be easily defeated should the security device or associated lock become compromised through tampering, for example.

Accordingly, there is a need for a secure display cabinet that allows for the secure display of retail items that may address one or more of the deficiencies or other shortcomings of known display solutions.

SUMMARY

In accordance with an example embodiment of the present disclosure, there is provided a merchandise display cabinet for storing items of merchandise. The merchandise display cabinet includes a housing defining an interior chamber for storing the items of merchandise. The housing includes a door panel that is moveable relative to the housing and configured for disposition in a closed position wherein the door panel is a barrier to access to the interior chamber, and an open position wherein access to the interior chamber is permitted. A lock assembly is operably coupled to the door panel for controlling access, via the door panel, to the interior chamber, the lock assembly being operable between an unlocked condition and a locked condition. A locking counterpart is operably coupled to the lock assembly, the locking counterpart having a first portion and a second portion and configured for disposition in a non-interfering position and an interfering position. A locking-counterpart receiver is disposed within the housing and configured for receiving the first portion of the locking counterpart. A door panel-displacement blocker disposed within the housing and configured for cooperating with the second portion of the locking-counterpart for impeding displacement of the door panel. The lock assembly, the locking counterpart, the locking counterpart receiver, and the door panel displacement blocker are cooperatively configured such that, while the lock assembly is disposed in the locked condition, the locking counterpart is disposed in the interfering position such that the merchandise display cabinet defines: a first interference condition wherein a first portion of the locking counterpart is disposed within the locking-counterpart receiver such that displacement of the door panel from the closed position to the open position is impeded by interference between the first portion of the locking counterpart and the locking-counterpart receiver; and a second interference condition wherein a second portion of the locking counterpart is cooperatively configured with the door panel-displacement blocker such that displacement of the door panel from the closed position to the open position is impeded by interference between the second portion of the locking counterpart and the door-panel-displacement blocker; and while the door panel is disposed in the closed condition and the lock assembly is disposed in the locked condition such that the locking counterpart is disposed in the interfering position, disposition of the first portion of the locking counterpart in a defeated condition such that it does not interfere with the locking-counterpart receiver is such that the second interference condition remains effected, such that displacement of the door panel from the closed position to the open position is prevented.

In accordance with another example embodiment of the present disclosure, there is provided a merchandise display cabinet for storing items of merchandise. The merchandise display cabinet includes a housing defining an interior chamber for storing the items of merchandise. The housing includes a door panel that is moveable relative to the housing and configured for disposition in a closed position wherein the door panel is a barrier to access to the interior chamber, and an open position wherein access to the interior chamber is permitted. A lock assembly is operably coupled to the door panel for controlling access, via the door panel, to the interior chamber, the lock being operable between an unlocked condition and a locked condition. The door panel is hingedly connected to a door-panel-housing connector, the door-panel-housing connector configured for coupling with a pair of door panel sliders for slidably connecting the door panel to the housing. The housing includes a pair of door-panel slider-receiving slots, wherein each door panel slider-receiving slot is configured for receiving a corresponding one of the door panel sliders, and disposition of the door panel in the open position is such that the door panel is disposed in: a first open condition wherein the door panel is disposed co-planar, or substantially co-planar with the door panel housing connector and external to the interior chamber of the housing; and a second open condition wherein the door panel is disposed within the interior chamber of the housing via rearward sliding of the door panel relative to the housing via sliding of the door panel sliders within the door panel-slider receiving slots.

In accordance with another example embodiment of the present disclosure, there is provided a kit for assembling a merchandise display cabinet. The kit includes a housing panel including a top panel portion and rear panel portion extending perpendicular to, or substantially perpendicular to, the top panel portion; a door panel including at least one lock assembly; a pair of end panels; a plurality of fasteners for releasably securing the pair of end panels to the top panel portion and the rear panel portion such that the end panels are oppositely disposed relative to one another to define a housing portion wherein: the door panel includes a door panel housing connector hingedly connected to the door panel. The kit further includes a pair of door panel sliders, wherein each slider is configured for connecting to the door panel housing connector, wherein: each end panel includes a door panel slider receiving slot configured for receiving one of the door panel sliders; and at least one of the end panels includes a locking counterpart receiver for cooperating with the at least one lock for controlling access to an interior chamber of the merchandise display cabinet.

In accordance with another example embodiment of the present disclosure, there is provided a merchandise display cabinet for use with a shelf panel of merchandise display feature, comprising: a housing having a door panel, a rear panel, a top panel, and a pair of oppositely disposed end panels, wherein the door panel, the rear panel, the top panel, and the pair of oppositely disposed end panels are cooperatively configured to define an interior chamber for storing items of merchandise; and a lock assembly operably coupled to the door panel of the housing for controlling access to the interior chamber, the lock being operable between an unlocked condition and a locked condition; wherein: the housing is configured for disposition on and releasable connection to the shelf panel of the merchandise display feature, wherein the releasable connection of the housing to the shelf panel is such that the shelf panel encloses the interior chamber; the door panel is moveable relative to the top panel, the rear panel, and the pair of oppositely disposed end panels of the housing and is configured for disposition in: a closed position, wherein the door panel is a barrier to access to the interior chamber; and an open position, wherein access to the interior chamber, is permitted; and the lock assembly includes a locking counterpart configured for disposition in a non-interfering position and an interfering position, such that: while the lock assembly is disposed in the unlocked condition, the locking counterpart is disposed in the non-interfering position such that interference to displacement of the door panel, from the closed position, into the open position, by the locking counterpart, is defeated such that displacement of the door panel from the closed position into the open position is permitted; and while the lock assembly is disposed in the locked condition, the locking counterpart is disposed in the interfering position such that interference to displacement of the door panel, from the closed position, into the open position, by the locking counterpart, is effected such that displacement of the door panel from the closed position into the open position is prevented, the interfering position defining: a first interference condition wherein a first portion of the locking counterpart is disposed within a locking-counterpart receiver such that displacement of the door panel from the closed position to the open position is impeded by interference between the first portion of the locking counterpart and the locking-counterpart receiver; and a second interference condition wherein a second portion of the locking counterpart is cooperatively configured with a door-panel-displacement blocker such that displacement of the door panel from the closed position to the open position is impeded by interference between the second portion of the locking counterpart and the door-panel-displacement blocker; the locking counterpart, the locking counterpart receiver and the door panel displacement blocker being cooperatively configured such that: while the lock assembly is disposed in the locked condition, the second interference condition remains effected such that displacement of the door panel from the closed position to the open position is prevented should the first interference condition be defeated.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Referring now to FIGS. 1-16, there is shown an example embodiment of a merchandise display cabinet 10 according to the present disclosure.

Figure 1:
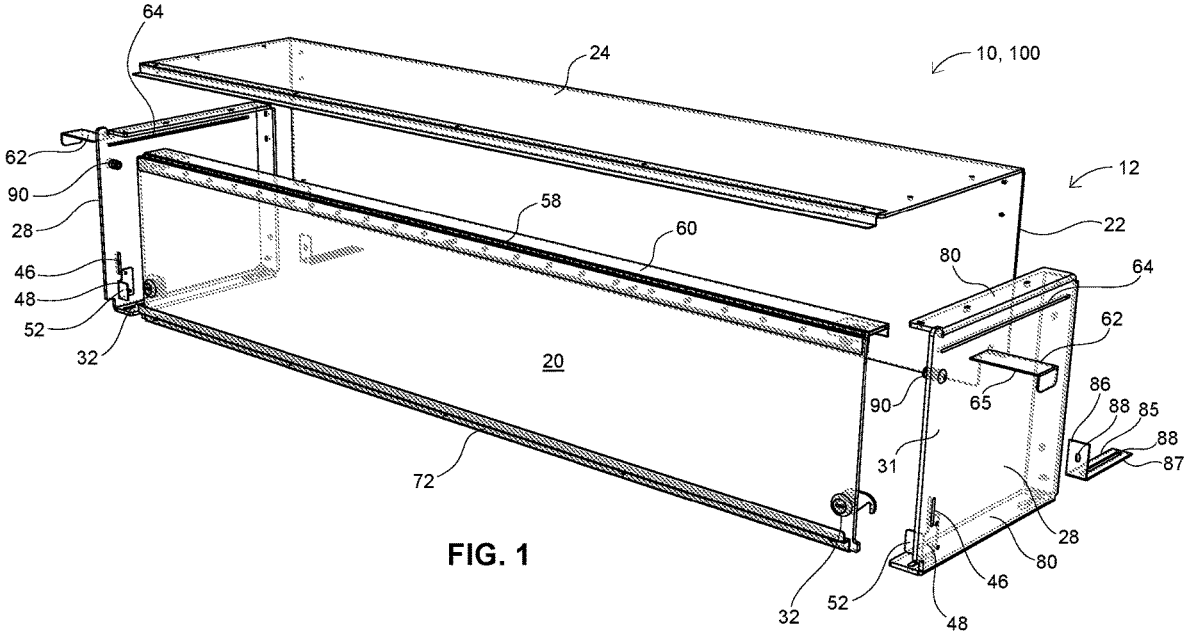
FIG. 1 is a perspective, exploded, assembly view of a merchandise display cabinet according to an example embodiment of the present disclosure.
Figure 2:
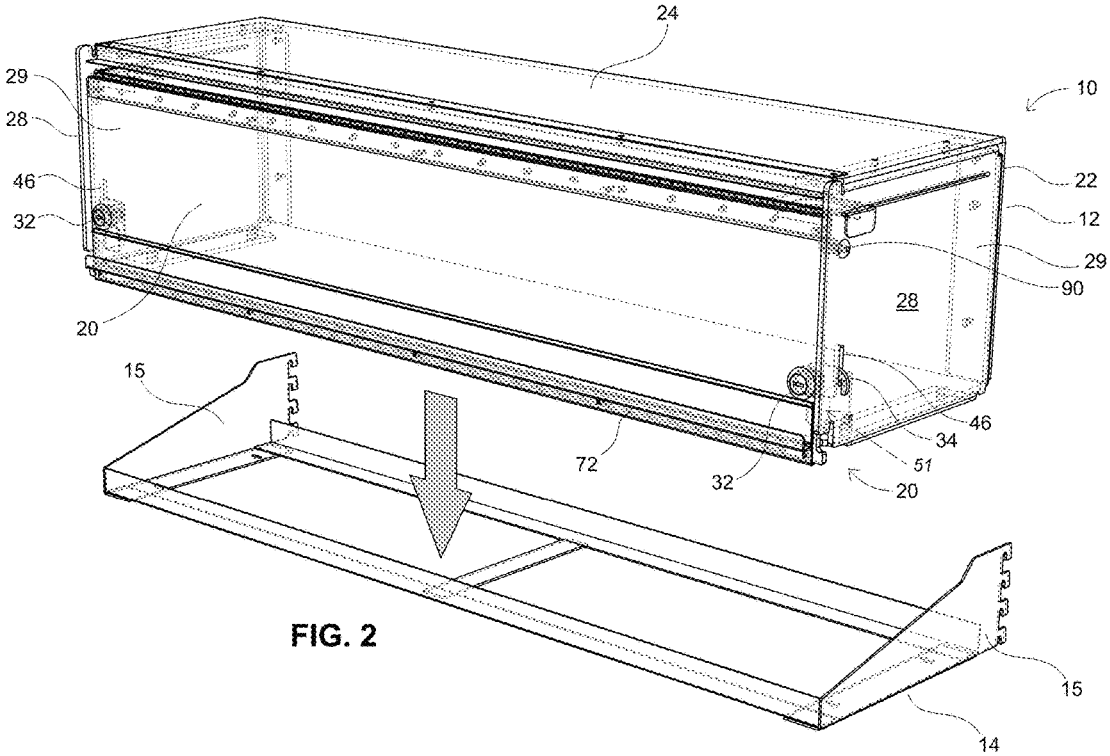
FIG. 2 is a front, perspective view of the assembled merchandise display cabinet of FIG. 1 disposed for installation on a conventional shelf panel of a merchandise display feature.
Figure 3:
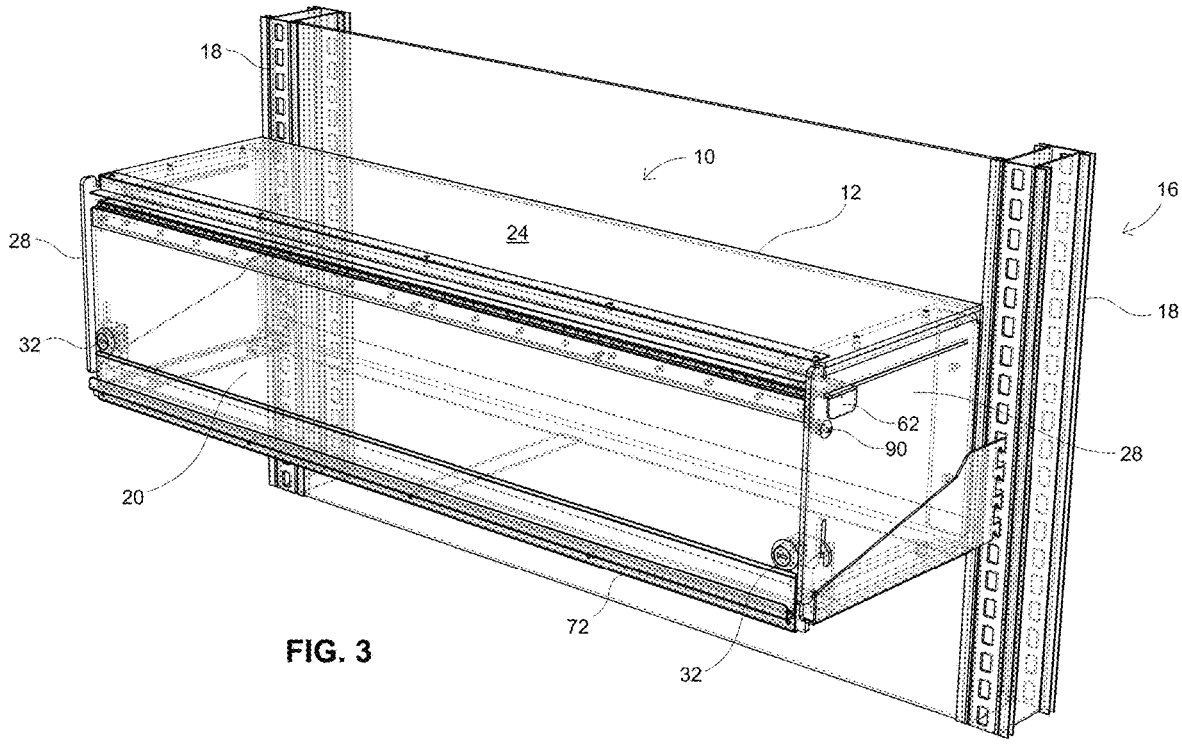
FIG. 3 is a front perspective view of the assembled merchandise display cabinet of FIG. 2 installed on the display shelf and mounted to a conventional merchandise display.

As shown in FIGS. 1-3, the merchandise display cabinet 10 includes a housing 12 configured for disposition on and releasable connection to a merchandise display feature 16. In some embodiments, for example, the merchandise display cabinet 10 is includes a bottom panel that is a shelf panel 14 configured for releasable connection to corresponding mounting brackets 18 associated with the merchandise display feature 16. In some embodiments, the merchandise display feature 16 includes a back panel 17 that extends between the corresponding mounting brackets 18, the shelf panel 14 including brackets 15 having hook portions 13 for releasably engaging with corresponding openings 19 provided in the mounting brackets 18 of the merchandise display feature 16. In some embodiments, for example, the merchandise display cabinet 10 includes a bottom panel, the merchandise display cabinet 10 configured for mounting on and releasable connect to a shelf panel 14 in the form of an underframe panel (as shown for instance in FIG. 2), the brackets 15 extend upwardly from the self-panel 14 and along a portion of the corresponding end walls of the merchandise display cabinet 10, as shown for instance in FIGS. 2-3. In other embodiments, for example, the brackets 15 may extend downwardly from the end edges of the shelf panel 14 as shown, for instance in the example embodiments of FIGS. 7-13, wherein the shelf panel 14 serves as the bottom panel of the merchandise display cabinet 10. Therefore, it will be understood that the merchandise display cabinet 10 can be configured for use with various forms of shelves of shelf panels for use in the display of retail items.

In some embodiments, for example, the housing 12 includes a front panel or door panel 20, a rear panel 22, a top panel 24, and a pair of oppositely disposed end panels 28. The door panel 20, the rear panel 22, the top panel 24, and the pair of oppositely disposed end panels 28 are cooperatively configured to define an interior chamber 30 for storing items of merchandise (not shown). In some embodiments, for example, the door panel 20, the rear panel 22, the top panel 24, and the pair of oppositely disposed end panels 28 are cooperatively configured to define a housing or housing portion 12 with an interior chamber 30. Accordingly, in some embodiments, the door panel 20, the rear panel 22, the top panel 24, and the pair of oppositely disposed end panels 28 are cooperatively configured such that the top panel 24 extends perpendicular to, or substantially perpendicular to, the rear panel 22, and that the end panels 28 are disposed such that they extend perpendicular to, or substantially perpendicular to, the rear panel 22 and the top panel 24. The front or door panel 20 is configured relative to the remaining portions of the housing 12 such that, while in the closed position, it is disposed parallel, or substantially parallel to, and opposite to the rear panel 22 and serves as a barrier to access to the interior chamber 30. While the housing 12 is disposed on and releasably connected to the shelf panel 14, the shelf panel 14 encloses the interior chamber 30 of the housing 12 that would otherwise open at the bottom or base portion of the housing 12. In other embodiment, the merchandise display cabinet 10 includes a bottom panel, the merchandise cabinet 10 being mounted on a corresponding shelf panel or shelf panel underframe for mounting the merchandise display cabinet 10 to a corresponding merchandise display feature.

In some embodiments, the door panel 20, the rear panel 22, the top panel 24, and the pair of oppositely disposed end panels 28 are made of clear, durable plastic material that allows visual inspection of the items of merchandise that may be stored within the merchandise display cabinet 10. The material selected for the door panel 20, the rear panel 22, the top panel 24, and the pair of oppositely disposed end panels 28 is also generally rigid that is not easily broken or shattered, as is known in the art. In some embodiments, the bottom panel or shelf panel 14 is a metal shelf panel, while in other embodiments, the merchandise display cabinet 10 includes a bottom panel that is also made of durable plastic material, the cabinet 10 being mounted to an external metal shelf panel or metal underframe.

The door panel 20 of the housing 12 is configured such that it is moveable relative to the housing 12 such that the door panel 20 is configured for disposition in a closed position 20', wherein access to the interior chamber 30 via the front of the housing 12 is prevented or blocked by the door panel 20, and an open position 20", wherein access to the interior chamber 30, via the front of the housing 12, is permitted. The closed position 20' of the door panel 20 is illustrated, for example, in FIGS. 2, 3 and 7, while the open position 20" is illustrated, for example, in FIGS. 8, 9 and 13.

In order to control access to the interior chamber 30 of the merchandise display cabinet 10 via the front or door panel 20, the merchandise display cabinet 10 includes a lock assembly 32 operably coupled to the door panel 20 of the housing 12 for controlling access to the interior chamber 30. In some embodiments, for example, the lock assembly 32 includes a single lock 33 while in other embodiments, the lock assembly 32 include a pair of locks 33, with one lock 33 being disposed at each bottom corner of the door panel 20.

The operation of the lock assembly 32 will now be described in further detail with reference to a single lock 33 although it will be understood that, for embodiments that include at least two locks 33, the description applies to each one of the locks 33 incorporated in the lock assembly 32 of the merchandise display cabinet 10.

The lock assembly 32 includes at least one lock 33 that is operable between an unlocked condition 32', wherein displacement of the door panel 20 from the closed position 20' to the open position 20" is permitted, and a locked condition 32" wherein displacement of the door panel 20 from the closed position 20' to the open position 20" is prevented. In embodiments that incorporate two locks 33, e.g. one at each bottom corner of the door panel 20, it will be understood that the door panel 20 is configured for disposition into the open position 20" once both locks 33 are disposed in the open condition 32". The lock (or locks) 33 allows items of merchandise to be displayed within the cabinet 10, while remaining secure such that theft of the particular items of merchandise is deterred and/or prevented as access to the items/products is limited to only authorized personnel or those with key access to the lock (or locks) 33.

The lock 33 includes a locking counterpart 34 that is operably coupled to the lock 33 and configured for disposition in a non-interfering position 34' and an interfering position 34". The lock 33 and the locking counterpart 34 are cooperatively configured such that, while the lock is disposed in the unlocked condition 32', the locking counterpart 34 is disposed in the non-interfering position 34' wherein interference to displacement of the door panel 20 from the closed position 20' into the open position 20", by the locking counterpart 34, is defeated such that displacement of the door panel 20 from the closed position 20' into the open position 20" is permitted. The unlocked condition of the lock 33 and the non-interfering position of the locking counterpart 34 are illustrated, for example, in FIG. 5. While the lock 33 is disposed in the locked condition 32", the locking counterpart 34 is disposed in the interfering position 34" wherein interference to displacement of the door panel 20 from the closed position 20' into the open position 20" is effected such that displacement of the door panel 20 from the closed position 20' into the open position 20" is prevented. The locked condition of one of the locks 33 and the interfering position of the locking counterpart 34 are illustrated, for example, in FIG. 6.

In some embodiments, for example, the locking counterpart 34 is rotatably coupled to the lock assembly 32 such that the locking counterpart 34 is disposed for rotation relative to the door panel 20 such that actuation of the lock assembly 32 between the unlocked condition 32' and locked condition 32" (and vice versa), effects rotation of the locking counterpart 34 between the corresponding non-interfering position 34' and the interfering position 34' (and vice versa). In some embodiments, for example, the locking counterpart 34 includes a cam profile as illustrated, for example, in FIG. 6.

Figure 4:
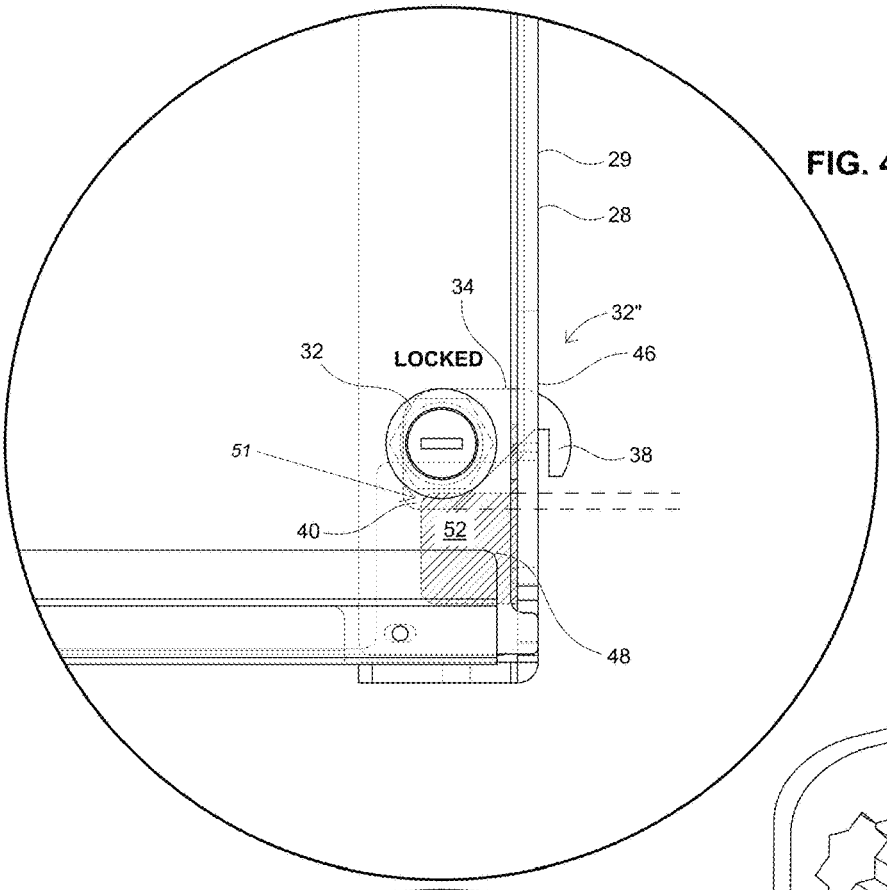
FIG. 4 is a detail view of the lock of the merchandise display cabinet in the locked condition.
Figure 6:
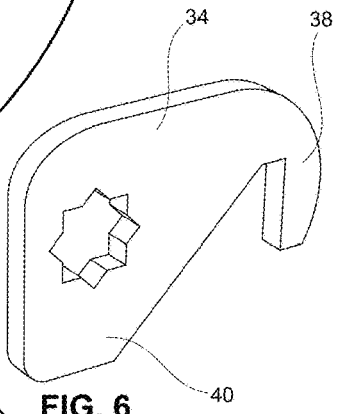
FIG. 6 is a detail front perspective view of the locking counterpart of the lock of FIGS. 4 and 5.
Figure 5:
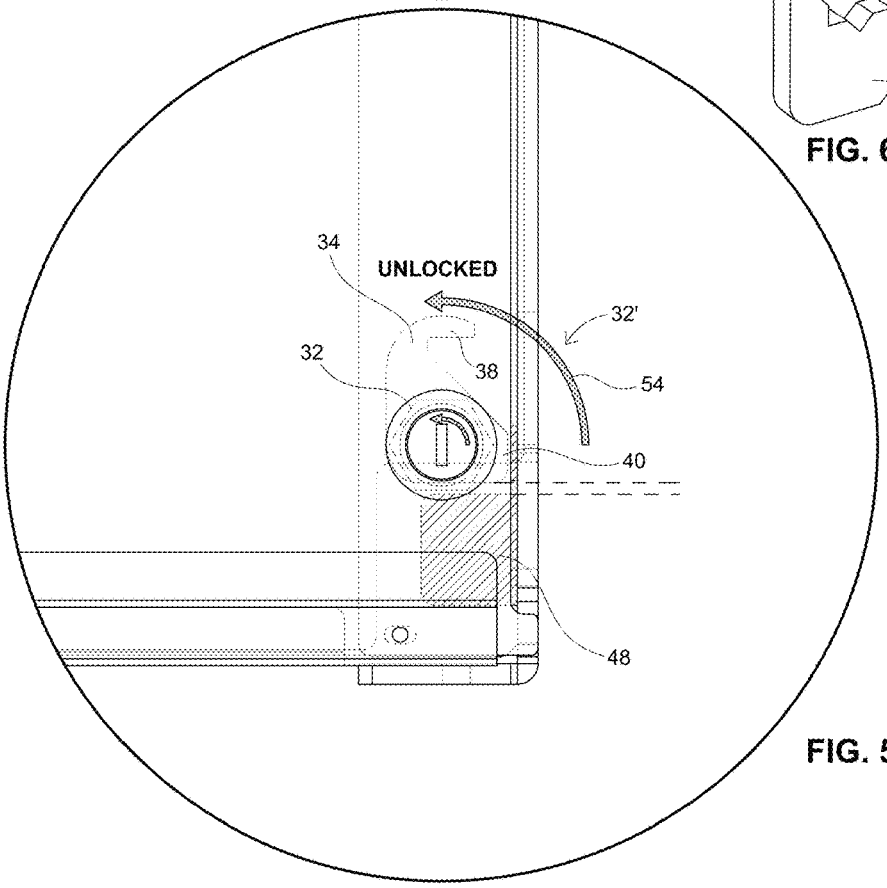
FIG. 5 is a detail view of the lock of the merchandise display cabinet in the unlocked condition; is a detail front perspective view of the locking counterpart of the lock of FIG. 4.
Figure 7:
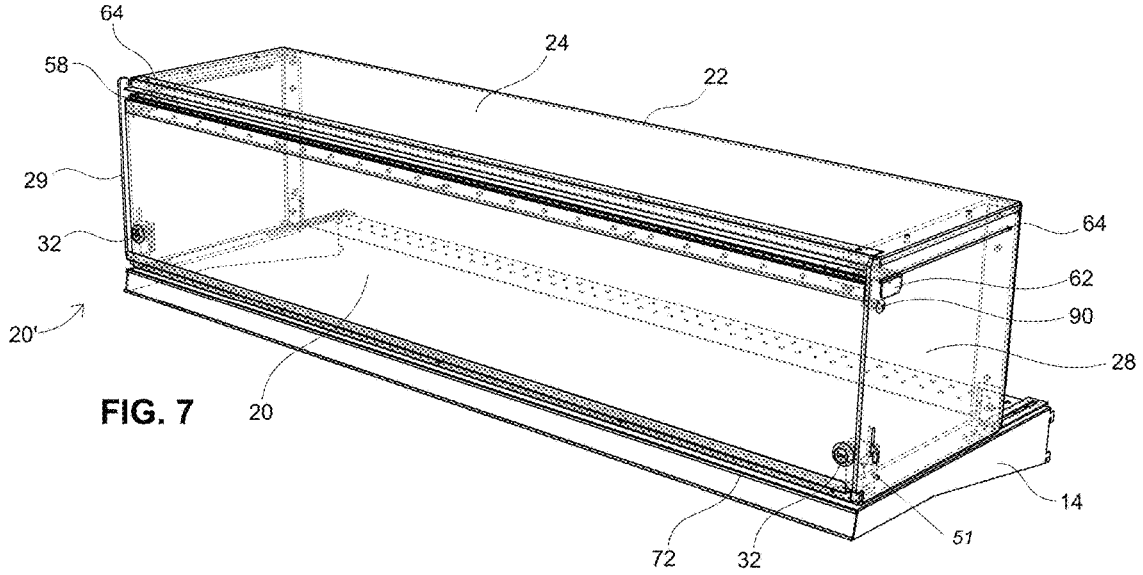
FIG. 7 is a front perspective view of the merchandise display cabinet fixed to the shelf panel of the merchandise display feature in the closed and locked condition.

Referring now to FIGS. 4-6, in some embodiments, for example, the locking counterpart 34 includes a first portion 38 and a second portion 40 and, while the locking counterpart 34 is disposed in the interference position 34", the interference position 34" defines a first interference condition 42 and a second interference condition 44. The first and second interference conditions 42, 44 are configured such that, provided at least one of the first and second interference conditions 42, 44 is in effect, the locked condition 32" remains effective such that the door panel 20 is prevented from being displaced from the closed position 20' into the open position 20".

In some embodiments, for example, the first interference condition 38 is such that the first portion 38 of locking counterpart 34 is disposed within a locking-counterpart receiver 46 such that displacement of the door panel 20 from the closed position 20' into the open position 20" is impeded by interference between the first portion 38 of the locking counterpart 34 and the locking counterpart receiver 46. The second interference condition 40 is defined by interference between the second portion 40 of the locking counterpart 34 and a door-panel displacement blocker 48. The interference between the second portion 40 of the locking counterpart 34 and the door panel displacement blocker 48 is such that displacement of the door panel 20 from the closed position 20' into the open condition 20" is impeded due to the second portion 40 of the locking counterpart 34 impinging against the door panel displacement blocker 48.

In order to improve the overall security of the merchandise display cabinet 10, the housing, the lock 33 and the locking counterpart 34 are cooperatively configured in an effort to provide a merchandise display cabinet 10 that provides improved resistance to tampering. Accordingly, the locking counterpart 34, the locking counterpart receiver 46 and the door panel displacement blocker 48 are cooperatively configured such that while the door panel 20 is disposed in the closed position 20' and the lock assembly 32 is disposed in the locked condition 32" such that the locking counterpart 34 is disposed in the interfering position 34" with the first and second interference conditions 42, 44 in effect, in the event that the first interference condition 42 becomes defeated, for instance by tampering, the second interference condition 44 remains in effect such that displacement of the door panel 20 from the closed position 20' to the open position 20" is prevented, even while the first interference condition 42 is defeated, thereby ensuring that the locked condition 32" remains effective.

Figure 16:
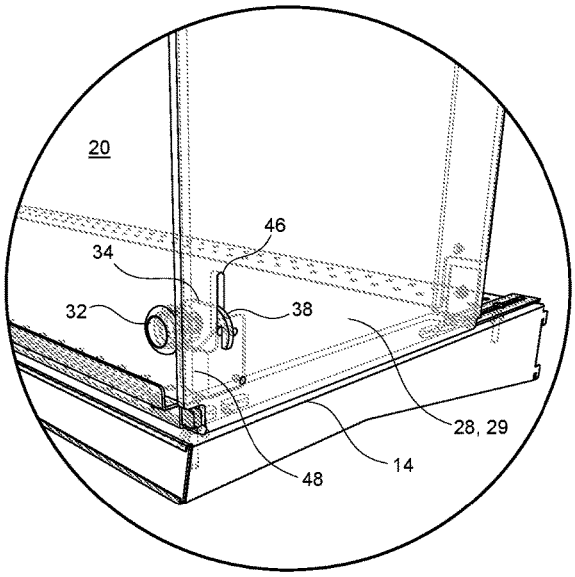
FIG. 16 is a detail, perspective view of the right end of the merchandise display cabinet with the door panel in the open position illustrating the connection of the merchandise display cabinet to the shelf panel.

Referring now to FIGS. 4 and 16, there is shown a detail view of a lock 33 of the lock assembly 32 of the merchandise display cabinet 10 disposed in the locked condition 32". The lock 33 is configured to cooperate with a corresponding one of the end panels of the pair of oppositely disposed end panels 28. Accordingly, the corresponding one of the end panels 28 that is configured for cooperating with the corresponding lock 33 is a lock-cooperating panel 29. In example embodiments wherein the lock assembly 32 includes only one lock 33, only one panel of the housing 12 is a lock-cooperating panel 29. In example embodiments wherein the lock assembly includes two locks 33, the housing 12 includes at least two lock-cooperating panels 29. In example embodiments wherein the lock assembly 32 includes two locks 33 that are disposed at the bottom corners of the door panel 20, the lock-cooperating panels 29 are the oppositely disposed end panels 28 of the housing 12. Accordingly, in the subject example embodiment, for each lock 33, independently, the lock-cooperating end panel 29 is the end panel that is disposed most proximal to the end 21 of the door panel 20 that includes the corresponding lock 33. However, it will be understood that the present disclosure is not necessarily limited to merchandise display cabinets wherein the lock assembly includes a pair of locks 33 that are disposed at the bottom corners of the door or door panel 20 door panel.

In the subject example embodiment, the locking-counterpart receiver 46 includes a slot 47 disposed within the corresponding lock-cooperating panel 29. Accordingly, in the subject example embodiment, for each lock 33, independently, the door panel 20, the lock-cooperating panel 29 and the slot 47 are cooperatively configured such that, while the door panel 20 is disposed in the closed position 20", disposition of the lock 32 into the locked condition 32", such that the locking counterpart 34 is disposed in the interfering position 34", is such that the first portion 38 of the locking counterpart 34 extends through the slot 47 from the interior chamber 30 and beyond the lock-cooperating panel 29 leaving a portion of the locking counterpart 34 protruding out from the merchandise display cabinet 10, as shown most clearly in FIGS. 4 and 16.

In some embodiments, for example, for each lock 33 of the lock assembly 32, independently, the door panel displacement blocker 48 is disposed within the interior chamber 30 of the merchandise display cabinet 10 and is connected to the housing 12 such that while the door panel 20 is disposed in the closed position 20 and the lock assembly 32 is disposed in the locked condition 32" such that the locking counterpart 34 is disposed in the interfering position, the second portion 40 of the locking counterpart is disposed behind the door panel displacement blocker 48. In some embodiments, for example, the door panel displacement blocker 48 includes at least a portion that extends perpendicular to, or substantially perpendicular to, the lock-cooperating end panel 29 such that, while the door panel 20 is disposed in the closed position 20' and the lock 33 is disposed in the closed condition 32", the second portion 40 of the locking counterpart 34 is disposed behind the door-panel displacement blocker 48. Accordingly, in some embodiments, the locking counterpart 34, the lock assembly 32, the door panel 20 and the door panel displacement blocker 48 are cooperatively configured such that while the lock assembly 32 is disposed in the locked condition such that the locking counterpart 34 is disposed in the interfering position, a door panel-displacement blocker-receiving gap 51 is disposed between an inner surface of the door panel 20 and the second portion 40 of the locking counterpart 34. Therefore, in some embodiments, while the door panel 20 is disposed in the closed position and the lock assembly is disposed in the locked condition, at least a portion of the door panel displacement blocker is disposed within the door panel displacement blocker receiving gap 51.

Therefore, in the event that the first portion 38 of the locking counterpart 34, that protrudes from the merchandise display cabinet 10 when the lock 32 is disposed in the locked condition 32", is broken-off or otherwise compromised such that it no longer interferes with locking counterpart receiver 46 or slot 47, displacement of door panel 20 from the closed position 20' to the open position 20" is prevented due to the second portion 40 of the locking counterpart 34 impinging against the door panel displacement blocker 48.

In some embodiments, for example, the door panel displacement blocker 48 includes a bracket 49 having a first portion 50 fixed to an inner surface 51 of the lock-cooperating end panel 29 and a second portion 52 extending away from and generally perpendicular to the inner surface 51 of the lock-cooperating end panel 29. Accordingly, while door panel 20 is disposed in the closed position 20', the second portion 52 of the door panel displacement blocker 48 is disposed parallel to, or substantially parallel to the door panel 20.

Figure 15:
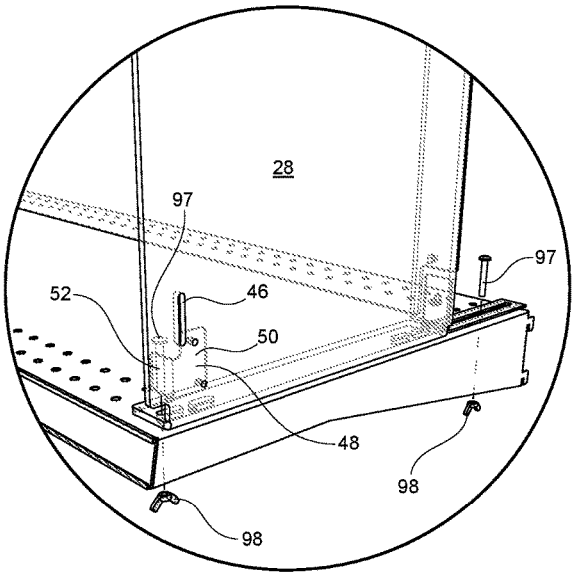
FIG. 15 is a detail, front perspective view of the right end of the perspective view of the merchandise display cabinet with the door panel in the closed position with the lock in the locked condition.

In some embodiments, in use, the merchandise display cabinet 10 is affixed to the shelf panel 14 of a merchandise display feature, as illustrated in FIGS. 2, 3 and 15, to securely store and display items of merchandise (not shown). In some embodiments, for example, the housing 12 is secured or otherwise fixed to the shelf panel 14 by threaded members 97, for instance screws that extend through aligned openings in portions of the housing panels and in the shelf panel 14 as shown, for instance, in FIG. 15 that are secured in position with corresponding lock nuts 98 or wing nuts, for example. The housing 12 may further be secured to the shelf panel 14 by way of externally mounted brackets 85 that have a first portion 86 fixed to the rear panel 22 of the housing 12 and a second portion 87 that extends away from the housing 12 in overlapping arrangement with a portion of the surface of the shelf panel 14, the second portion 87 of the bracket 85 have openings 88 that are intended for disposition in overlapping arrangement or alignment with one or more openings provided in the shelf panel 14, the bracket 85 being secured to the shelf panel 14 by threaded members 97 with corresponding wing nuts or lock nuts 98, disposed on the underside of the shelf panel 14 as shown, for instance, in FIG. 16.

When access to the interior chamber 30 of the merchandise display cabinet 10 is required, an authorized person actuates the lock assembly 32 such that it becomes disposed in the unlocked condition 32'. Accordingly, in embodiments that include only one lock 33, only one lock 33 requires actuation into the unlocked condition 32'. In embodiments that include two or more locks 33, actuation of the lock assembly into the unlocked condition 32' requires actuation of each lock 33 into the unlocked condition 32'. A detail view of the unlocked condition 32' of a lock 33 of the lock assembly 32 is shown, for example, in FIG. 5.

Figure 8:
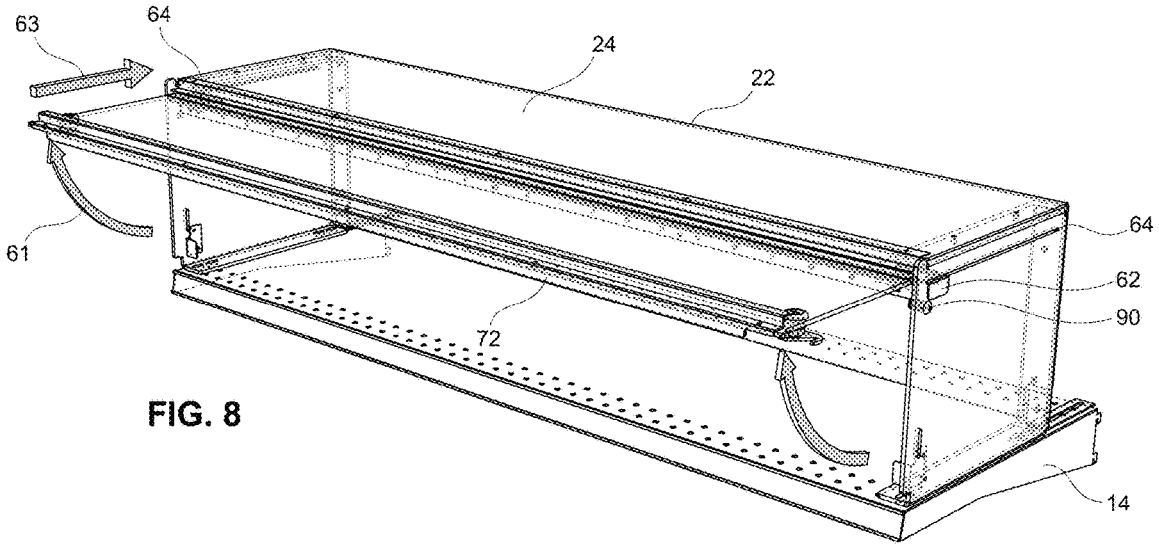
FIG. 8 is a front perspective view of the merchandise display cabinet of FIG. 7 the first step in the opening of the display cabinet.
Figure 9:
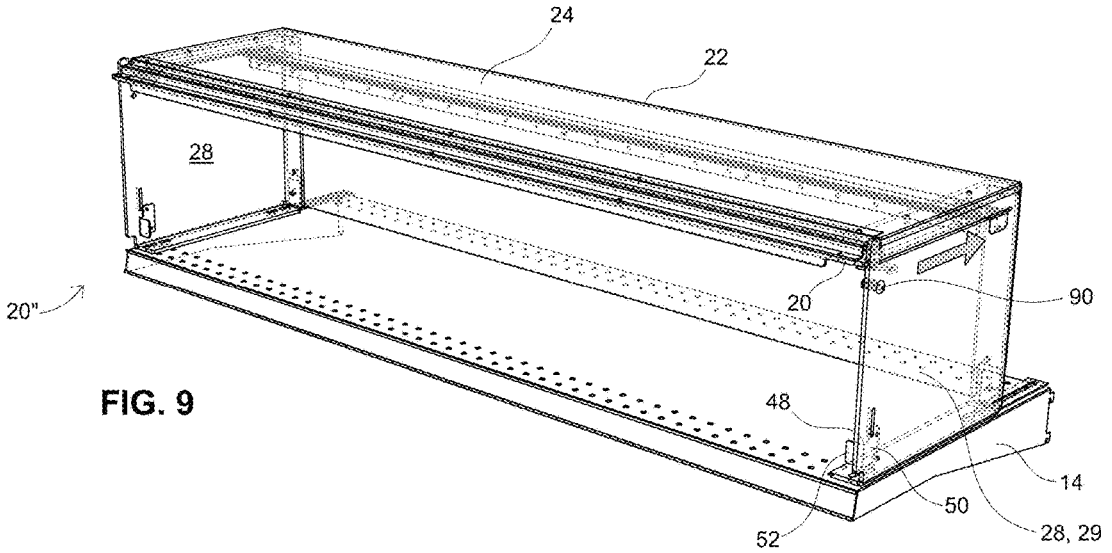
FIG. 9 is a front perspective view of the merchandise display cabinet of FIG. 7 the fully open condition
Figure 10:
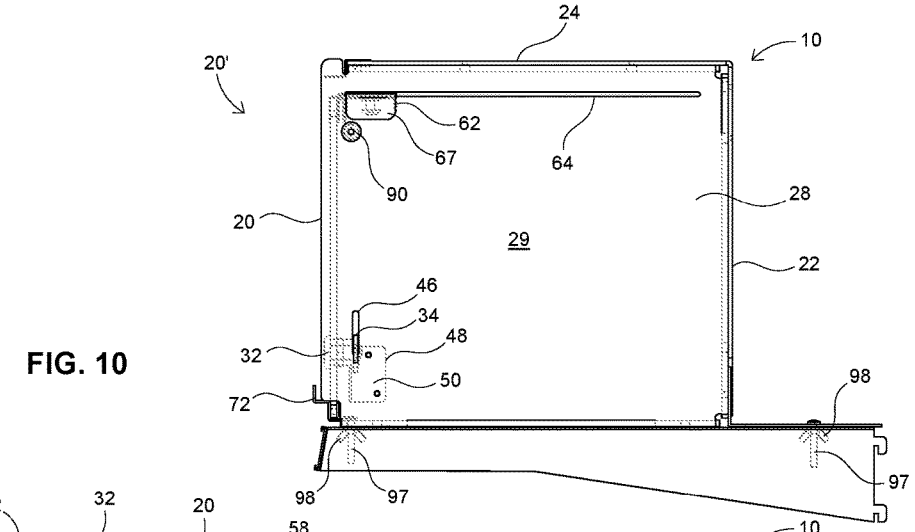
FIG. 10 is a right end elevation view of the merchandise display cabinet of FIG. 7.

For each lock 33 of the lock assembly 32, independently, actuation of the lock 32 from the locked condition 32" to the unlocked condition 32' effects rotation of the locking counterpart 34, in a counter-clockwise direction, as illustrated by schematic directional arrow 54 in FIG. 5, such that first portion 38 of the locking counterpart 34 is rotated out of engagement with the locking counterpart receiver 46 or slot 47. Simultaneously, with the rotation of the locking counterpart 34, the second portion 40 of the locking counterpart 34, is also rotated out of its interference condition with the door-panel displacement blocker 48. Once the locking counterpart 34 has been rotated, relative to the door panel 20, out of engagement with the locking counterpart receiver 46 and out of the way of the door-panel displacement blocker 48, for each of the locks 33 in the lock assembly 32, the door panel 20 can be rotated about its connection relative to the housing 12 such that the door panel 20 is disposed for displacement out of its closed position and for disposition into its open position 20". Disposition of the door panel 20 into its open position 20", includes a first step wherein the door panel 20 is rotated relative to the top panel 24 such that it becomes disposed in a plane parallel to, or substantially parallel to, the plane of the top panel 24 and disposed slightly below the top panel 24 as illustrated, for example, in FIG. 8. Further rearward displacement of the door panel 20, relative to the top panel 24 disposes the door panel 20 in its fully open position 20' as illustrated in FIG. 9.

In some embodiments, for example, the closed position 20' is such that the door panel 20 is disposed perpendicular to, or substantially perpendicular to, the top panel 24 and is disposed opposite to the rear panel 22 of the housing 12. In the open position 20", the door panel 20 is disposed, relative to the housing 12, such that the door panel 20 is disposed within, or substantially within, the interior chamber 30 if the housing 12 such that the door panel 20 is disposed parallel to, or substantially parallel to the top panel 24.

In order to effect disposition of the door panel 20 into its open condition 20", the door panel 20 is hingedly connected, relative to housing 12, such that the door panel 20 is configured for rotation about a hinge 58 that is disposed relative to the housing 12. In some embodiments, for example, the door panel 20 is hingedly connected relative to the top panel 24 of the housing 12. Accordingly, in some embodiments, for example, the door panel 20 is hingedly connected to a door-panel-housing connector 60 that is configured for slidably and hingedly connecting the door panel to the housing 12.

In some embodiments, for example, the door-panel-housing connector 60 is configured for coupling with a pair of door panel sliders 62. The door panel sliders 62 are each configured for extending through a corresponding door panel sliding slot 64 disposed in the corresponding end panel 28 of the housing 12, and for releasably coupling to the door panel housing connector 60. In some embodiments, for example, each door panel slider 62 includes a first portion 65 for extending through the door panel sliding slot 64 and for releasably coupling to the door panel housing connector 60, and a second portion 67 for retaining the door panel slider 62 within the door panel sliding slot 64. In the subject example embodiment, the door panel slider 62 is configured such that the first portion 65 extends through the door panel sliding slot 64 from the outside surface 31 of the end panel 28 towards the inside surface 27 of the end panel 28 and into the interior chamber 30 such that the first portion 65 is disposed parallel to, or substantially parallel to, the door panel housing connector 60 and the top panel 34 of the housing 12. The second portion 67 extends generally perpendicular to the first portion 65 such that the second portion 67 downwardly depends from an end of the first portion 65 of the door panel slider 62 for retaining the door panel slider 62 within the door panel sliding slot 64. Accordingly, in some embodiments, for example, the door panel slider 62 includes an L-bracket.

Figure 11:
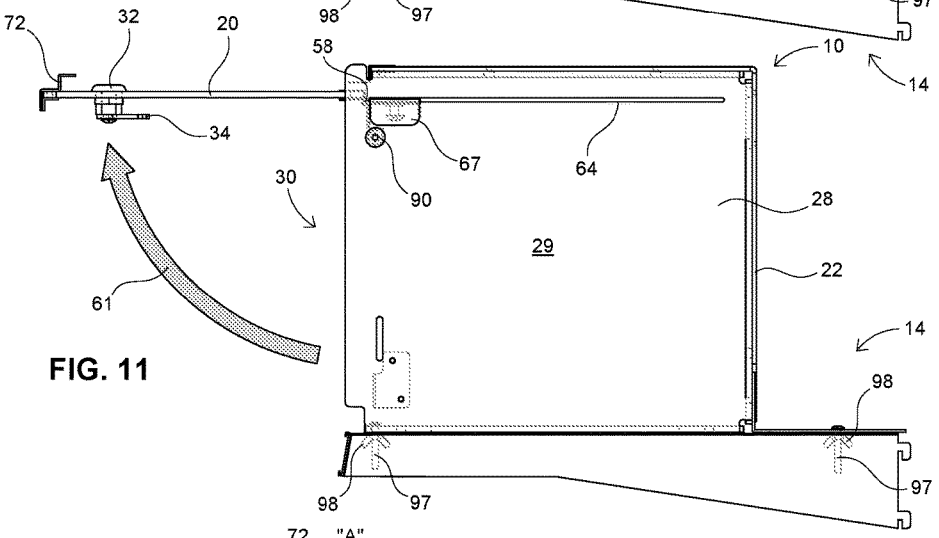
FIG. 11 is a right end elevation view of the merchandise display cabinet of FIG. 8.
Figure 13:
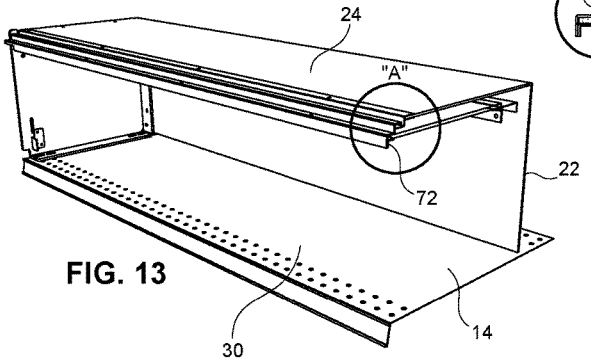
FIG. 13, is a front perspective view of the merchandise display cabinet of FIG. 9 with the right end panel removed for ease of illustration.
Figure 12:
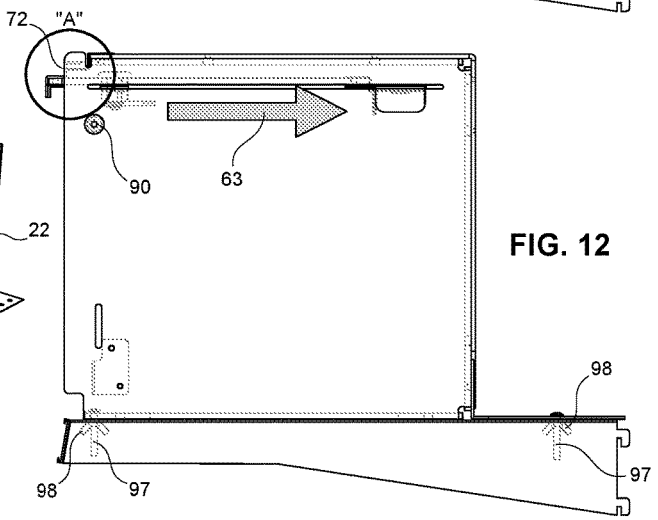
FIG. 12 is a right end elevation view of the merchandise display cabinet of FIG. 9.
Figure 14:
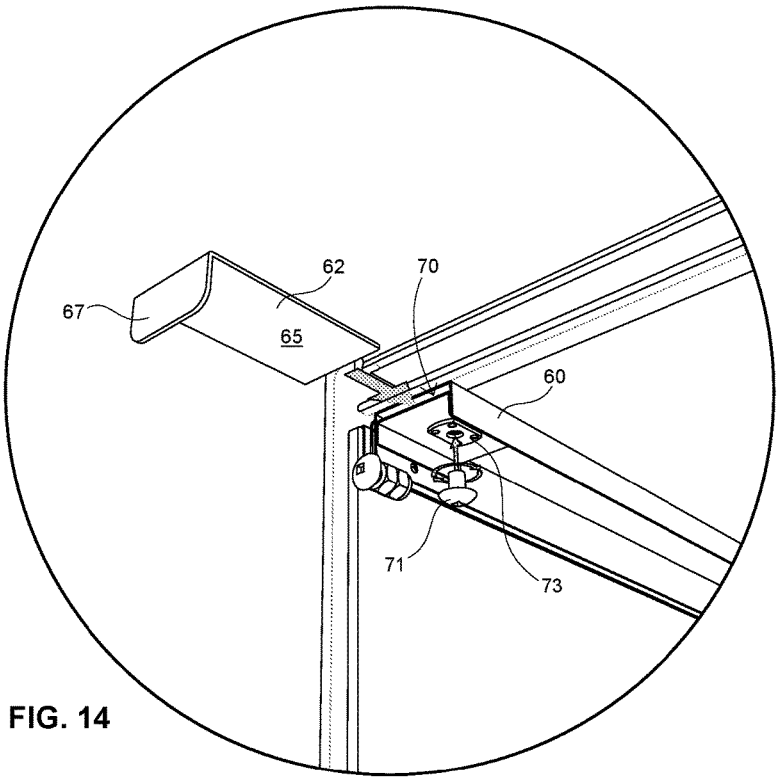
FIG. 14 is detail, partially exploded view of the assembly of the door panel to the merchandise display cabinet, with the end panel removed for ease of illustration.

Referring, in particular to FIG. 14, in some embodiments, for example, the door panel slider 62 is connected to the door panel housing connector 60 by a fastener or threaded member 71 that releasably couples the door panel slider 62 to the corresponding end of the door panel housing connector 60. In some embodiments, for example, the door panel housing connector 60 includes a metal profile that defines a receiving slot 70 for receiving the first portion 65 of the door panel slider 62, the fastener or threaded member 71, or any other suitable fastening means, coupling the door panel slider 62 to the door panel housing connector 60 via the receiving slot 70 by way of a corresponding opening 73 or threaded opening in the door panel housing connector 60. Accordingly, in some embodiments, for example, the door panel 20 is suspended, relative to the housing 12, by its connection to the door panel housing connector 60 and the connection between the door panel sliders 62 and the housing 12 through the door panel sliding slots 64, the door panel 20 rotating relative to the door panel housing connector 60 via hinge 58. Therefore, in order to effect disposition of the door panel 20 into its open position 20", while the lock 32 is disposed in the unlocked condition 32', the door panel 20 is rotated about its hinge 58 until the door panel 20 becomes disposed co-planar or substantially co-planar with the door panel housing connector 60, as illustrated in FIG. 8 and FIG. 11 by directional arrow 61. Once the door panel 20 is disposed co-planar with, or substantially co-planar with the door panel housing connector 60, the door panel 20 can then be pushed or slid rearwardly into the interior chamber 30 of the housing 12, the door panel sliders 62 sliding along the corresponding door panel sliding slots 64 as illustrated by directional arrow 63 in FIGS. 8 and 12. Accordingly, disposition of the door panel 20 in the open position 20" is such that the door panel sliders 62 become disposed at the rearmost end of the door panel sliding slots 64, as illustrated, for example in FIG. 12.

In order to prevent the door panel 20 from rotating downwardly about its hinge 58 once the door panel 20 is pushed rearwardly into the interior chamber 30 of the housing 12, the door panel 20 includes a door panel retainer 72 configured for releasably retaining the door panel 20 in its open position 20 relative to the top panel 24. In some embodiments, for example, the door panel retainer 72 includes a Z-bracket fixed at the bottom edge 23 of the door panel 20 that serves to hook the bottom edge of the door panel 20 to the front edge 25 of the top panel 25 as illustrated most clearly in FIG. 13. In some embodiments, the door panel retainer 72 includes a reinforcing portion 73 configured for receiving and overlapping a bottom edge of the door panel for increasing rigidity of the bottom edge of the door panel 20. In some embodiments, for example, the front edge of the top panel 24 includes a corresponding reinforcing panel for engaging with the door panel retainer 72. Therefore, once the user releases their grip on the door panel 20 once it has been disposed in the open position 20', the door panel 20 will remain in the open position 20' until such time as it is manually closed by the user.

In some embodiments, for example, the merchandise display cabinet 10 may be provided as a kit 100 for assembling a merchandise display cabinet 10 that is configured for use with a shelf panel 14 of a merchandise display feature. In some embodiments, the kit 100 includes the front or door panel 20, the rear panel 22, the top panel 24 and the pair of end panels 28. In some embodiments, the rear panel and the top panel 24 are of unitary one piece construction with the top panel 24 extending perpendicular to, or substantially perpendicular to, the rear panel 22, as a single unit piece. In some embodiments, for example, the rear panel 22 and the top panel 24 are provided as separate panels for constructing or assembling the housing 12.

In some embodiments, for example, each end panel 28 includes mounting portions 80 extending from the top, rear and lower edges 82, 84, 86 of the end panel 28. Each of the mounting portions 80 provides an interface surface 88 configured for juxtaposition or mating contact with a corresponding portion of the inner surface of the top panel 24, the rear panel 22 and the shelf panel 14 of the merchandise display feature, when the assembled housing 12 is disposed on and releasably connected to the shelf panel 14. In embodiments wherein the top panel 24 is provided separately to the rear panel 22, one of the top panel 24 and rear panel 22 may also be provided with a mounting portion (not shown) for disposition in overlapping relationship with a corresponding portion of either the top or rear panel 24, 22.

Figure 17:
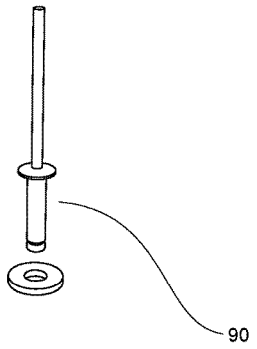
FIG. 17 is a detail view of an example embodiment of a fastener for securing the housing panels of the merchandise display cabinet together.
Figure 18:
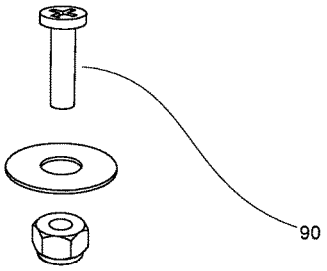
FIG. 18 is a detail view of another example embodiment of a fastener for securing the housing panels of the merchandise display cabinet together.

In some embodiments, for example, the end panels 28 are connected to the top and rear panels 24, 22 by fasteners 90 that are disposed at regular intervals along the interface areas between the mounting portions 80 of the end panels 28 and corresponding portion of the rear panel 22 and top panel 24. In some embodiments, the end panels 28 are connected to the top panel 24 and the rear panel 22 using rivets, as shown for instance in FIG. 17. In other embodiments, the end panels 28 may be connected to the top and rear panels 24, 22 by way of threaded fasteners, for example screws with corresponding lock nuts, as shown in FIG. 18, that are used to secure the panels together through corresponding openings provided in the panels and the corresponding mounting portions 80.

In some embodiments, the kit 100 includes a bottom panel 13 that may be integrally formed with the rear panel 22 or that may be provided separate thereto and configured to releasable connection with the end panels 28 to define the housing 12, the kit further including an underframe 14 configured for releasable connection to the housing and for supporting the assembled merchandise display cabinet on a corresponding merchandise display feature.

As described above, the door panel 20 is connected to the housing 12 by way of the door panel connector 60 and the corresponding door panel sliders 62. Given that the sliding connection between the door panel 20 and the housing 12 is provided through the interaction between the door panel sliders 62 and corresponding door panel sliding slots 64 formed within panels of the housing 12 and not via separate sliding and/or rail mechanisms, assembly of the merchandise display cabinet 10 may be facilitated. As well, by providing a merchandise display cabinet 10 that can be assembled from individual components, packaging and shipping of the product is also facilitated and may provide reduced costs since the merchandise display cabinet 10 can be shipped without having to be fully assembled.

Accordingly, by providing the merchandise display cabinet 10 as a kit 100 including the separate panel components, the merchandise display cabinet 10 can be sold and/or shipped to customers in a generally flat condition may allow for easier packaging and shipping of the product.

In some embodiments, for example, the merchandise display cabinet 10 includes additional security features for preventing and/or deterring tampering with the display cabinet in an effort to gain unauthorized access to the contents of the interior chamber 30. For example, in some embodiments, the merchandise display cabinet includes blockers 90 that extend into the interior chamber 30 of the housing from each of the end panels 28. The blockers 90 extend generally perpendicular to the inner surface of the corresponding end panel such that they are disposed within the interior chamber 30 behind the door panel 20 while the door panel 20 is disposed in the closed position 20'. Accordingly, in the event that an individual attempts to forcefully push the door panel 20 rearwardly into the housing 12, the door panel 20 will impinge against the one or more blockers 90 which interference serves to prevent, or substantially prevent, the collapse of the door panel 20 into the interior chamber 30, the blockers 90, thereby providing an additional degree of security. In some embodiments, for example, the blockers 90 include a bolt with a lock nut that are secured within corresponding openings provided in the corresponding end panel 28.

While various embodiments of the merchandise display cabinet 10 have been described, it will be understood that certain adaptations and modifications of the described embodiments can be made. Therefore, the above discussed embodiments are considered to be illustrative and not restrictive.

What is claimed is:

1. A merchandise display cabinet, comprising:

a housing including a top panel, a bottom panel, a rear panel, and a pair of oppositely disposed end panels, the housing defining an interior chamber for storing items of merchandise;

a door panel that is moveable relative to the housing and configured for disposition in a closed position wherein the door panel is a barrier to access to the interior chamber, and an open position wherein access to the interior chamber is permitted;

a lock assembly operably coupled to the door panel for controlling access, via the door panel, to the interior chamber, the lock assembly being operable between an unlocked condition, wherein displacement of the door panel from the closed position to the open position is permitted, and a locked condition, wherein displacement of the door panel from the closed position to the open position is prevented;

a locking counterpart operably coupled to the lock assembly such that the locking counterpart is disposed for rotation between a non-interfering position and an interfering position upon actuation of the lock assembly from the unlocked condition to the locked condition, the locking counterpart having a first portion, extending in a first direction relative to the lock assembly, and a second portion, extending in a second direction relative to the lock assembly, such that at least a portion of the second portion extends perpendicular to the first portion;

a locking-counterpart receiver disposed within a lock-cooperating panel of the housing and configured for receiving the first portion of the locking counterpart; and a door panel displacement blocker disposed within the housing such that the door panel displacement blocker extends perpendicular to the lock-cooperating panel for cooperating with the second portion of the locking counterpart, while the locking counterpart is disposed in the interfering position, for impeding displacement of the door panel;

wherein:

the housing, the door panel, the lock assembly, the locking counterpart, the locking-counterpart receiver, and the door panel displacement blocker are cooperatively configured such that:

while the door panel is disposed in the closed position and the lock assembly is disposed in the unlocked condition:

the locking counterpart is disposed in the non-interfering position;

there is an absence of interference between the first portion of the locking counterpart and the locking-counterpart receiver, and the second portion of the locking counterpart and the door panel displacement blocker; and displacement of the door panel from the closed position to the open position, via pivoting of the door panel relative to the housing, is permitted;

and while the door panel is disposed in the closed position and the lock assembly is disposed in the locked condition:

the locking counterpart is disposed in the interfering position with effect that:

the first portion of the locking counterpart is disposed within the locking-counterpart receiver;

the second portion of the locking counterpart is disposed relative to the door panel displacement blocker such that at least a portion of the door panel displacement blocker is disposed intermediate the door panel and the second portion of the locking counterpart;

displacement of the door panel from the closed position to the open position, via pivoting of the door panel relative to the housing is prevented by:

(i) a first interference condition effected between the first portion of the locking counterpart and the locking-counterpart receiver; and (ii) a second interference condition effected between the second portion of the locking counterpart and the door panel displacement blocker;

and the first portion and the second portion of the locking counterpart are co-operatively configured such that defeating of the first interference condition, while the lock assembly remains disposed in the locked condition, such that there is an absence of interference between the first portion of the locking counterpart and the locking-counterpart receiver, is with effect that the second interference condition remains effective such that displacement of the door panel from the closed position to the open position, via pivoting of the door panel relative to the housing, is prevented; and the door panel is connected to the housing via a door panel housing connector, the door panel being hingedly connected to the door panel housing connector for pivoting between the closed position, wherein the door panel is disposed parallel, or substantially parallel to and opposite the rear panel, and a first open condition wherein the door panel is disposed co-planar, or substantially co-planar, with the door panel housing connector and external to the interior chamber defined by the housing, while the lock assembly is disposed in the unlocked condition;

the door panel housing connector is slidably connected to the housing such that, while the door panel is disposed in the first open condition, the door panel and door panel housing connector are slidable, relative to the housing, between the first open condition and a second open condition, wherein the door panel is disposed within the housing via rearward sliding of the door panel and door panel housing connector relative to the housing such that the door panel is disposed within the interior chamber, parallel to, or substantially parallel to, the top panel of the housing;

the door panel housing connector includes a pair of door panel sliders, wherein said door panel sliders are disposed at respective ends of the door panel housing connector;

each one of the end panels, independently, includes a door-panel slider-receiving slot configured for receiving a corresponding one of the door panel sliders; and the door panel includes a door panel retainer for releasably retaining the door panel in the second open condition, the door panel retainer configured for engaging a front edge of the top panel of the housing.

2. The merchandise display cabinet as claimed in claim 1; wherein:

the lock-cooperating panel is one of the end panels of the housing;

the locking-counterpart receiver is a slot disposed within the lock-cooperating panel; and disposition of the first portion of the locking counterpart within the locking-counterpart receiver is such that the first portion extends through the slot in the lock-cooperating panel from the interior chamber and beyond the lock-cooperating panel.

3. The merchandise display cabinet as claimed in claim 1; wherein:

while the door panel is disposed in the closed position and the lock assembly is disposed in the locked condition and the first interference condition is defeated, displacement of door panel from the closed position to the open position is impeded by the second portion of the locking counterpart impinging against the door panel displacement blocker.

4. The merchandise display cabinet as claimed in claim 1; wherein:

the locking counterpart, the lock assembly, the door panel, the lock-cooperating panel and the door panel displacement blocker are cooperatively configured such that:

while the lock is disposed in the locked condition such that the locking counterpart is disposed in the interfering position, a door panel displacement blocker-receiving gap is disposed between an inner surface of the door panel and the second portion of the locking counterpart; and while the door panel is disposed in the closed position and the lock assembly is disposed in the locked condition, at least a portion of the door panel displacement blocker is disposed within the door panel displacement blocker-receiving gap.

5. The merchandise display cabinet as claimed in claim 1; wherein:

the door panel displacement blocker includes a bracket having a first portion fixed to the lock-cooperating panel and a second portion extending away from an inner surface of the lock-cooperating panel into the interior chamber such that the second portion is parallel to, or substantially parallel to, the door panel while the door panel is disposed in the closed position.

6. The merchandise display cabinet as claimed in claim 1, wherein:

the door panel retainer includes a reinforcing portion that is configured for receiving and overlapping a bottom edge of the door panel for increasing the rigidity of the bottom edge of the door panel.

7. The merchandise display cabinet as claimed in claim 1; wherein:

the bottom panel is a shelf panel of a merchandise display feature;

and the top panel, the rear panel, the pair of oppositely disposed end panels and the door panel are cooperatively configured and releasably secured relative to the shelf panel such that the shelf panel encloses the interior chamber, the shelf panel including retainers for releasably retaining the housing to the merchandise display feature.

8. The merchandise display cabinet as claimed in claim 1; further comprising:

an underframe configured for supporting and releasably retaining the housing;

wherein:

the underframe includes retainers for releasably retaining the merchandise display cabinet to a merchandise display feature.

9. A merchandise display cabinet, comprising:

a housing defining an interior chamber for storing items of merchandise, the housing including a top panel, a bottom panel, a rear panel, and a pair of oppositely disposed end panels;

a door panel that is moveable relative to the housing and configured for disposition in a closed position wherein the door panel is a barrier to access to the interior chamber, and an open position wherein access to the interior chamber is permitted;

a lock assembly operably coupled to the door panel for controlling access, via the door panel, to the interior chamber, the lock assembly being operable between an unlocked condition and a locked condition;

wherein:

the door panel is hingedly connected to a door-panel-housing connector, the door panel housing connector configured for coupling with a pair of door panel sliders for slidably connecting the door panel to the housing;

the housing includes a pair of door panel slider-receiving slots, each one of said door panel slider-receiving slots is configured for receiving a corresponding one of the pair of door panel sliders;

disposition of the door panel in the open position is such that the door panel is disposed in:

a first open condition wherein the door panel pivots relative to the housing, via the hinged connection with the door panel housing connector, such that the door panel is disposed co-planar, or substantially co-planar, with the door panel housing connector and external to the interior chamber of the housing; and a second open condition wherein the door panel is disposed within the interior chamber of the housing via rearward sliding of the door panel, relative to the housing, via sliding of the door panel sliders within the door panel slider-receiving slots;

and the door panel includes a door panel retainer for releasably retaining the door panel in the second open condition, the door panel retainer configured for engaging a front edge of the top panel of the housing.

10. The merchandise display cabinet as claimed in claim 9;

wherein:

each said door panel slider includes a bracket having a first portion configured for extending through the corresponding one of said door panel slider-receiving slots and connecting to the door panel housing connector, and a second portion extending perpendicular to, or substantially perpendicular to, the first portion for retaining the door panel slider within the door panel slider-receiving slot relative to the housing.

11. The merchandise display cabinet as claimed in claim 9;

wherein:

the pair of oppositely disposed end panels each include one of said pair of door panel slider-receiving slots integrally formed within the end panel.

12. A kit for assembling a merchandise display cabinet, comprising:

a housing panel including a top panel portion and a rear panel portion extending perpendicular to, or substantially perpendicular to, the top panel portion;

a pair of end panels;

a plurality of fasteners for releasably securing the pair of end panels to the top panel portion and the rear panel portion of the housing panel such that the end panels are oppositely disposed relative to one another such that the housing panel and the pair of end panels together to define a housing portion;

a door panel including at least one lock assembly, the at least one lock assembly including a locking counterpart disposed for rotation relative to the lock assembly, and a door panel retainer extending from a bottom edge of the door panel and configured for releasably retaining the door panel in an open position, relative to the housing portion;

wherein:

the door panel includes a door panel housing connector and is hingedly connected to the door panel housing connecter, the door panel housing connector configured for slidably connecting the door panel to the housing portion;

each said end panel includes a door panel slider-receiving slot configured for cooperating with the door panel housing connector;

at least one end panel of the pair of end panels is a lock-cooperating panel and includes a locking-counterpart receiver for cooperating with the locking counterpart; and the housing panel, the pair of end panels, the plurality of fasteners and the door panel are configured for assembly such that:

the door panel that is moveable relative to the housing portion and configured for disposition in a closed position wherein the door panel is a barrier to access to an interior chamber of the housing portion, and an open position wherein access to the interior chamber is permitted;

the at least one lock assembly is operably coupled to the door panel for controlling access to the interior chamber, the at least one lock assembly being operable between an unlocked condition, wherein displacement of the door panel from the closed position to the open position is permitted, and a locked condition, wherein displacement of the door panel from the closed position to the open position is prevented, the locking counterpart being operably coupled to the at least one lock assembly such that the locking counterpart is disposed for rotation between a non-interfering position and an interfering position upon actuation of the at least one lock assembly from the unlocked condition to the locked condition;

and disposition of the door panel in the open position, from the closed position, is such that the door panel is disposed in:

a first open condition wherein the door panel pivots, relative to the housing portion, via the hinged connection with the door panel housing connector, such that the door panel is disposed co-planar, or substantially co-planar with the door panel housing connector and is external to the interior chamber of the housing portion; and a second open condition wherein the door panel is disposed within the interior chamber of the housing portion, via rearward sliding of the door panel relative to the housing portion via sliding of the door panel housing connectors within the door panel slider-receiving slots; and releasable retention of the door panel in the second open condition is effected via engagement of the door panel retainer with a front edge of the top panel portion of the housing panel.

13. The kit as claimed in claim 12, wherein:

the locking counterpart includes a first portion extending in a first direction, relative to the at least one lock assembly, and a second portion extending in a second direction, relative to the at least one lock assembly, such that at least a portion of the second portion extends along an axis that is perpendicular to at least a portion of the first portion;

the kit further comprises:

a door panel displacement blocker; and assembly of the merchandise display cabinet is with effect that:

the door panel displacement blocker is disposed within the interior chamber of the housing portion such that door panel displacement blocker extends perpendicular relative to the lock-cooperating panel and is positioned relative to the locking-counterpart receiver such that:

while the door panel is disposed in the closed position and the at least one lock assembly is disposed in the unlocked condition:

the locking counterpart is disposed in the non-interfering position;

there is an absence of interference between: (i) the first portion of the locking counterpart and the locking-counterpart receiver, and (ii) the second portion of the locking counterpart and the door displacement blocker; and displacement of the door panel from the closed position to the open position, via pivoting of the door panel relative to the housing, is permitted;

and while the door panel is disposed in the closed position and the at least one lock assembly is disposed in the locked condition:

the locking counterpart is disposed in the interfering position such that:

the first portion of the locking counterpart is disposed within the locking-counterpart receiver;

the second portion of the locking counterpart is disposed relative to the door panel displacement blocker such that the door panel displacement blocker is disposed intermediate the door panel and the second portion of the locking counterpart;

displacement of the door panel from the closed position to the open position, via pivoting of the door panel relative to the housing portion, is prevented by:

(i) a first interference condition effected between the first portion of the locking counterpart and the locking-counterpart receiver; and (ii) a second interference condition effected between the second portion of the locking counterpart and the door panel displacement blocker;

and the first portion and the second portion of the locking counterpart are co-operatively configured such that defeating of the first interference condition, while the at least one lock assembly remains disposed in the locked condition, such that there is an absence of interference between the first portion of the locking counterpart and the locking-counterpart receiver is with effect that the second interference condition remains effective such that displacement of the door panel from the closed position to the open position, via pivoting of the door panel relative to the housing, is prevented.

14. The kit as claimed in claim 12, further comprising:

a bottom panel configured for coupling to the housing portion; and an underframe for supporting and releasably retaining the assembled merchandise display cabinet relative to a merchandise display feature the underframe including mounting brackets for cooperating with corresponding upright mounting brackets for suspending the merchandise display cabinet relative to the merchandise display feature.

15. A merchandise display cabinet for use with a shelf panel of a merchandise display feature, comprising:

a housing having a rear panel, a top panel, and a pair of oppositely disposed end panels;

a door panel operably coupled to the housing such that the door panel is disposed for displacement relative to the housing between a closed position and an open position, the door panel and the housing together defining an interior chamber;

and a lock assembly operably coupled to the door panel;

wherein:

the housing is configured for disposition on and releasable connection to the shelf panel of the merchandise display feature, wherein the releasable connection of the housing to the shelf panel is such that the housing, the door panel and the shelf panel encloses the interior chamber;

the lock assembly is operable between an unlocked condition, wherein displacement of the door panel from the closed position to the open position is permitted, and a locked condition, wherein displacement of the door panel from the closed position to the open position is prevented;

the lock assembly includes a locking counterpart operably coupled to the lock assembly such that the locking counterpart is disposed for rotation between a non-interfering position and an interfering position, the locking counterpart having a first portion extending in a first direction relative to the locking assembly and a second portion extending in a second direction relative to the lock assembly such that at least a portion of the second portion of the locking counterpart extends perpendicular relative to at least a portion of the first portion of the locking counterpart;

at least one of said pair of oppositely disposed end panels is a lock-cooperating panel and includes a locking-counterpart receiver configured for receiving the first portion of the locking counterpart;

the housing further comprises a door panel displacement blocker disposed within the interior chamber and extending perpendicular to the lock-cooperating panel, the door panel displacement blocker configured for co-operating with the second portion of the locking counterpart while the locking counterpart is disposed in the interfering position;

the door panel is operably coupled to the housing such that the door panel is moveable relative to the top panel, the rear panel, and the pair of oppositely disposed end panels of the housing such that:

while the door panel is disposed in the closed position:

the door panel is disposed parallel to the rear panel and is a barrier to access to the interior chamber;

and disposition of the door panel in the open position is effected via disposition of the door panel in:

a first open condition, wherein the door panel pivots relative to the housing such that the door panel is disposed in a plane that is parallel to the top panel and is external to the interior chamber; and a second open condition, wherein the door panel is disposed within the interior chamber, via rearward sliding of the door panel relative to the housing, such that the door panel is disposed parallel to and below the top panel;

and while the door panel is disposed in the closed position and the lock assembly is disposed in the locked condition:

the locking counterpart is disposed in the interfering position such that:

the first portion of the locking counterpart is disposed within the locking-counterpart receiver;

the second portion of the locking counterpart is disposed relative to the door panel displacement blocker such that the door panel displacement blocker is disposed intermediate the door panel and the second portion of the locking counterpart;

displacement of the door panel from the closed position to the open position, via pivoting of the door panel relative to the housing, is prevented by:

(i) a first interference condition effected between the first portion of the locking counterpart and the locking-counterpart receiver; and (ii) a second interference condition effected between the second portion of the locking counterpart and the door panel displacement blocker;

and the first portion and the second portion of the locking counterpart are co-operatively configured such that defeating of the first interference condition, while the lock assembly remains disposed in the locked condition, such that there is an absence of interference between the first portion of the locking counterpart and the locking-counterpart receiver is with effect that the second interference condition remains effective such that displacement of the door panel from the closed position to the open position, via pivoting of the door panel relative to the housing, is prevented;

the door panel further comprising a door panel retainer for releasably retaining the door panel in the second open condition, the door panel retainer configured for engaging a front edge of the top panel.

16. The merchandise display cabinet as claimed in claim 15;

wherein:

the locking-counterpart receiver is a slot disposed within the at least one lock-cooperating panel; and disposition of the first portion of the locking counterpart within the locking-counterpart receiver is such that the first portion extends through the slot in the lock-cooperating panel from the interior chamber and beyond the lock-cooperating panel.

17. The merchandise display cabinet as claimed in claim 15;

wherein:

the door panel displacement blocker is disposed within the interior chamber and is connected to the housing, such that:

while the door panel is disposed in the closed position and the lock assembly is disposed in the locked condition such that the locking counterpart is disposed in the interfering position, the second portion of the locking counterpart is disposed behind the door panel displacement blocker such that displacement of the door panel relative to the housing from the closed position to the first open condition is impeded by the second portion of the locking counterpart impinging against the door panel displacement blocker.

18. The merchandise display cabinet as claimed in claim 17;

wherein:

the door panel is hingedly connected to a door panel housing connector;

the door panel housing connector comprises a pair of door panel sliders, wherein each door panel slider of the pair of door panel sliders is disposed at a respective end of the door panel housing connector;

and each one of the end panels, independently, includes a door panel slider-receiving slot configured for receiving one of the door panel sliders;

wherein:

disposition of the door panel in the second open condition, from the first open condition, is effected via sliding of the door panel sliders within the door panel slider-receiving slots.

* * * * *